US012352491B2

(12) United States Patent
You et al.

(10) Patent No.: US 12,352,491 B2
(45) Date of Patent: Jul. 8, 2025

(54) REFRIGERATOR

(71) Applicant: SAMSUNG ELECTRONICS CO., LTD., Suwon-si (KR)

(72) Inventors: Youngmin You, Suwon-si (KR); Kyoungsun Park, Suwon-si (KR); Jinyoung Song, Suwon-si (KR); Sangjune Lee, Suwon-si (KR); Yeongjun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 77 days.

(21) Appl. No.: 18/198,059

(22) Filed: May 16, 2023

(65) Prior Publication Data

US 2023/0288132 A1 Sep. 14, 2023

Related U.S. Application Data

(63) Continuation of application No. PCT/KR2021/016248, filed on Nov. 9, 2021.

(30) Foreign Application Priority Data

Jan. 6, 2021 (KR) ..... 10-2021-0001513

(51) Int. Cl.
*F25D 23/06* (2006.01)
*F25D 25/02* (2006.01)

(52) U.S. Cl.
CPC ..... *F25D 23/063* (2013.01); *F25D 23/067* (2013.01); *F25D 25/02* (2013.01); *F25D 2317/067* (2013.01)

(58) Field of Classification Search
CPC .... F25D 23/063; F25D 23/067; F25D 23/066; F25D 25/02; F25D 2317/067;
(Continued)

(56) References Cited

U.S. PATENT DOCUMENTS 5,004,302 A 4/1991 Stocking et al.
5,495,726 A * 3/1996 Lee ..... F25D 17/065 62/413
6,962,116 B2 11/2005 Bienick et al.
8,152,258 B2 4/2012 Kang et al.
8,651,600 B2 2/2014 Cheong et al.
(Continued)

FOREIGN PATENT DOCUMENTS

DE 102013206856 A1 * 10/2014 ..... F25D 23/067
DE 102016225367 A1 * 6/2018 ..... A47F 3/0426
(Continued)

OTHER PUBLICATIONS

DE102016225367 translation (Year: 2018).*
(Continued)

*Primary Examiner* — Hiwot E Tefera
(74) *Attorney, Agent, or Firm* — Sughrue Mion, PLLC

(57) ABSTRACT

Provided is a refrigerator that includes a storage compartment, a shelf disposed inside the storage compartment, an angle provided to fix a position of the shelf, and a duct mounted on one surface of the storage compartment and to which the angle is coupled. The angle includes a bent part formed to be bent inward from one end of the angle, and the duct includes a fixing protrusion disposed to protrude from the duct toward the storage compartment so as to fix the angle by pressing an inner surface of the bent part.

17 Claims, 12 Drawing Sheets

(58) Field of Classification Search
CPC ..... F25D 2317/0672; F25D 17/062; F25D 17/08; F25D 17/042; F25D 2317/0665; F25D 23/06; F25D 23/069; A47B 57/42; A47B 57/48; A47B 96/028; A47B 96/061; A47B 96/02; A47B 57/08; A47B 57/16; A47B 57/30; A47B 57/36; A47B 96/024; A47F 2003/046; A47F 3/0408
See application file for complete search history.

(56) References Cited

U.S. PATENT DOCUMENTS

| | | | | |
|---|---|---|---|---|
| 8,740,322 | B2 | 6/2014 | Moon et al. | |
| 10,697,689 | B2 * | 6/2020 | Lindel | F25D 23/062 |
| 2005/0126206 | A1 * | 6/2005 | Oh | F25D 17/062 62/407 |
| 2013/0277323 | A1 * | 10/2013 | Cheong | A47B 57/42 211/119.003 |
| 2017/0191743 | A1 * | 7/2017 | Lee | F25D 25/02 |
| 2018/0164021 | A1 * | 6/2018 | Lindel | F25D 23/06 |
| 2018/0164029 | A1 * | 6/2018 | Lindel | F25D 23/067 |
| 2018/0187961 | A1 * | 7/2018 | Lim | F25D 27/00 |
| 2022/0205710 | A1 * | 6/2022 | Akalan | F25D 23/066 |

FOREIGN PATENT DOCUMENTS

| | | | |
|---|---|---|---|
| JP | 9-61036 | A | 3/1997 |
| JP | 2001-14135 | A | 1/2001 |
| JP | 2004-33537 | A | 2/2004 |
| KR | 10-1999-0012446 | A | 2/1999 |
| KR | 10-0488089 | B1 | 5/2005 |
| KR | 10-2006-0103064 | A | 9/2006 |
| KR | 10-2008-0045368 | A | 5/2008 |
| KR | 10-2008-0079161 | A | 8/2008 |
| KR | 10-1059244 | B1 | 8/2011 |
| KR | 10-2013-0118617 | A | 10/2013 |
| KR | 10-1387645 | B1 | 4/2014 |
| KR | 10-2014-0131758 | A | 11/2014 |
| KR | 10-2015-0003628 | A | 1/2015 |
| KR | 10-2017-0092335 | A | 8/2017 |
| KR | 10-1840169 | B1 | 5/2018 |
| KR | 10-1896466 | B1 | 9/2018 |
| KR | 10-2131054 | B1 | 7/2020 |
| KR | 20210081633 | A * | 7/2021 |

OTHER PUBLICATIONS

JP2004033537 translation (Year: 2004).*
KR20150003628 (Year: 2015).*
International Search Report dated Mar. 8, 2022 issued by the International Searching Authority in counterpart International Application No. PCT/KR2021/016248 (PCT/ISA/210).
International Written Opinion dated Mar. 8, 2022 issued by the International Searching Authority in counterpart International Application No. PCT/KR2021/016248 (PCT/ISA/237).

* cited by examiner

REFRIGERATOR

CROSS-REFERENCE TO RELATED APPLICATIONS

This application is a bypass continuation of PCT International Application No. PCT/KR2021/016248, which was filed on Nov. 9, 2021, and claims priority to Korean Patent Application No. 10-2021-0001513, filed on Jan. 6, 2021, in the Korean Intellectual Property Office, the disclosures of which are incorporated herein by reference in their entireties.

BACKGROUND

1. Field

The disclosure relates to a refrigerator including an angle and a duct having an improved structure.

2. Description of Related Art

In general, a refrigerator, which is an apparatus for keeping food fresh, is a home appliance provided to supply cold air to food by including a storage compartment for storing food and a cold air supply device for supplying cold air to the storage compartment.

The storage compartment is kept at a temperature within a constant range required to keep food fresh. The refrigerator has a cooling cycle for exchanging heat with intake air, and cool air generated by the cooling cycle is supplied to the storage compartment through a duct.

A shelf for storing food is disposed inside the refrigerator. The shelf is provided such that a height thereof is variable depending on a size of food or a food storage container. An angle supports the shelf to allow the height of the shelf to be variable.

However, the angle has a coupling part to be fixed inside the refrigerator, and when such a coupling part is exposed to a user, the aesthetics of the storage compartment may deteriorate.

In addition, when the angle and the duct are coupled in a manufacturing line, it is not easy to couple the angle to the duct so as not to scratch the duct or parts around the storage compartment, which may decrease productivity.

SUMMARY

Provided is a refrigerator in which a coupling part of an angle is not exposed to a user without a separate part.

Further, provided is a refrigerator including an angle and a duct having an improved structure so that the angle may be temporarily fixed to the duct.

According to an aspect of the disclosure, a refrigerator includes a storage compartment, a shelf disposed inside the storage compartment, an angle disposed to fix a position of the shelf, and a duct mounted on one surface of the storage compartment and to which the angle is coupled. The angle includes a bent part formed to be bent inward from one end of the angle, and the duct includes a fixing protrusion provided to protrude from the duct toward the storage compartment so as to fix the angle by pressing an inner surface of the bent part.

The bent part may include a coupling hole configured to couple with the duct. The coupling hole may be provided at a rear of the angle with respect to a front surface of the angle exposed to the storage compartment.

The fixing protrusion may include a hook part disposed to press the inner surface of the bent part toward the inside of the duct.

The hook part may be disposed to come into contact with the bent part between the front surface of the angle and the rear of the angle.

The angle may include a plurality of shelf fixing holes formed on a front surface thereof.

The duct may further include a front cover disposed to form a front exterior of the duct by being exposed to the storage compartment, and a support plate disposed to fix the front cover at the rear of the front cover and accommodate the angle.

The support plate may include an angle mounting part formed to be recessed inward from a front surface of the support plate so that the angle is mounted thereon.

The fixing protrusion may be formed on the angle mounting part.

The front cover may include a cutout portion formed by being cut at a position corresponding to the angle mounting part, and a front surface of the angle may be exposed to the storage compartment through the cutout portion.

The support plate may further include a rib disposed to extend in a horizontal direction from the front surface of the support plate toward the storage compartment, and disposed to protrude forward of the front cover.

The angle may further include a stepped part disposed to be stepped with the front surface of the angle by being bent outward from the other end of the angle.

The support plate may include a separation space formed between the rib and the angle mounting part, and disposed to accommodate the stepped part.

The coupling hole may be a first coupling hole, and the support plate may include a second coupling hole disposed at a position corresponding to the first coupling hole.

The bent part and the fixing protrusion may be a first bent part and a first fixing protrusion, respectively, and the refrigerator may further include a second bent part formed to be bent inward from the other end of the angle, and a second fixing protrusion disposed to protrude from the duct toward the storage compartment to press an inner surface of the second bent part.

The first bent part and the second bent part may be disposed symmetrically with respect to a center of the angle.

The first bent part may be formed from a top end of the angle, and is bent in a direction toward a bottom end of the angle.

The coupling hole may be disposed at the rear of the angle such that the coupling hole is spaced apart from the front surface of the angle in a direction away from the storage compartment.

The rib may be disposed to prevent the stepped part of the angle being separated from the duct.

The overall aesthetics of the inside of a storage compartment can be improved by making a coupling part of an angle invisible.

As the structure is improved such that the angle can be temporarily fixed to a duct before the angle is coupled to the duct, work efficiency can be increased by minimizing the time required for coupling the angle.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
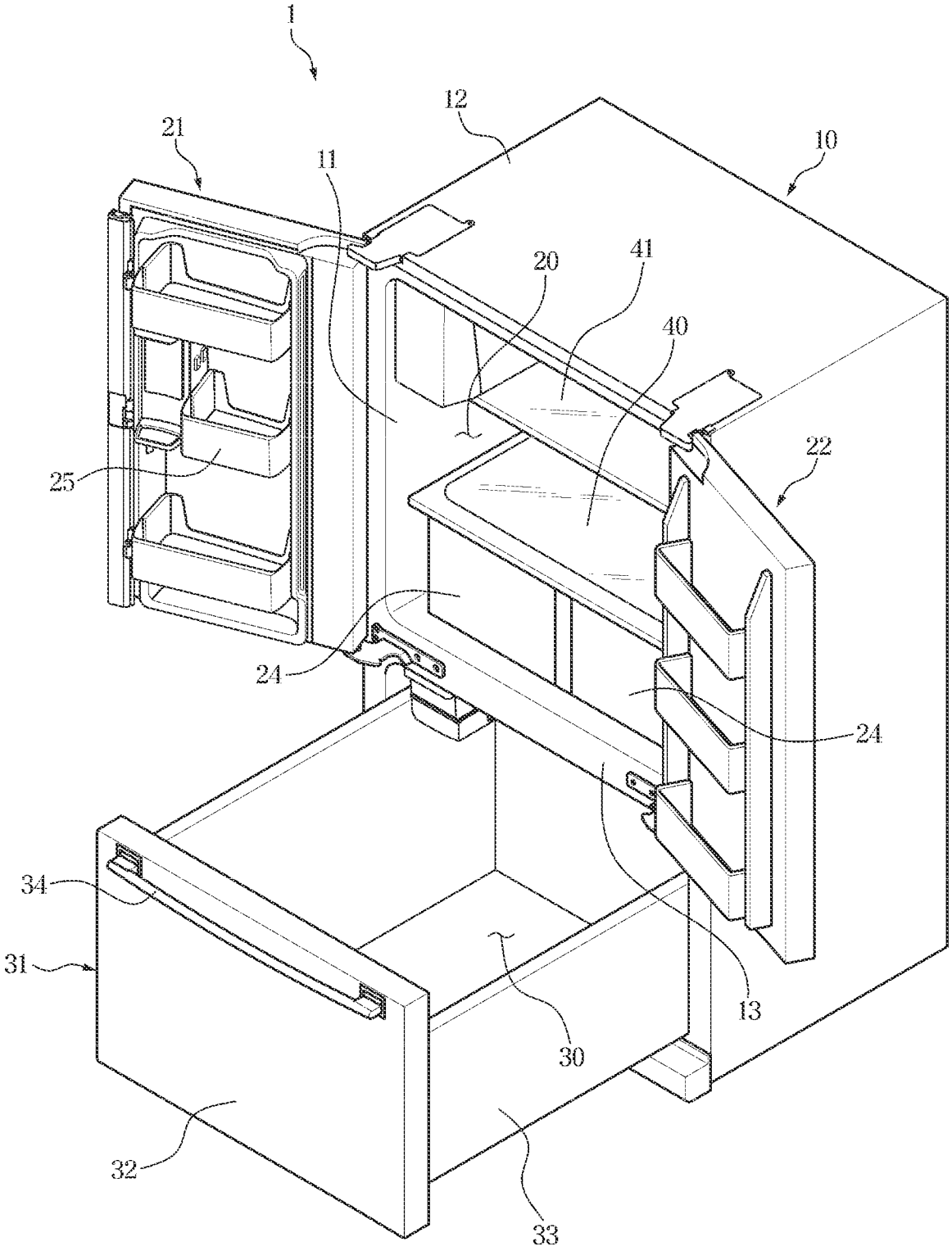
FIG. 1 is a perspective view of a refrigerator, according to an embodiment.

The embodiments herein and the various features and advantageous details thereof are explained more fully with reference to the non-limiting embodiments that are illustrated in the accompanying drawings and detailed in the following description, where similar reference characters denote corresponding features consistently throughout. Descriptions of well-known components and processing techniques are omitted so as to not unnecessarily obscure the embodiments herein. Also, the various embodiments described herein are not necessarily mutually exclusive, as some embodiments may be combined with one or more other embodiments to form new embodiments. The examples used herein are intended merely to facilitate an understanding of ways in which the embodiments herein may be practiced and to further enable those skilled in the art to practice the embodiments herein. Accordingly, the examples should not be construed as limiting the scope of the embodiments herein.

Terms used in the present disclosure are used merely to describe a specific embodiment, and it is to be understood that the terms are not intended to limit the scope of the disclosure. For example, a singular expression includes a plural expression, unless otherwise specified. As another example, expressions such as "comprise", "may comprise", "include", "may include", "has", or the like are used to designate a presence of a corresponding characteristic (e.g., elements such as numerical value, function, operation, or component, etc.), and not to preclude a presence or a possibility of additional characteristics.

Expressions used herein to describe various components, such as "first", "second", "1st", "2nd", and so on, may be used to refer to various elements regardless of order and/or importance, and it should be noted that the expressions are merely used to distinguish an element from another element and not to limit the relevant elements. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

FIG. 1 is a perspective view of a refrigerator, according to an embodiment.

As illustrated in FIG. 1, a refrigerator 1 may include a main body 10, and a plurality of storage compartments 20 and 30 provided inside the main body 10 and having an open front such that objects may be taken in and out.

The main body 10 may include an inner case 11 and an outer case 12. The outer case 12 may be provided to form an exterior of the refrigerator 1. The outer case 12 may be coupled to the outside of the inner case 11. The outer case 12 may be formed of a metal material having excellent durability and aesthetics. However, the material of the outer case 12 is not limited thereto.

The inner case 11 may be disposed inside the outer case 12. The inner case 11 may form the storage compartment 20. The inner case 11 may be made of a plastic material to be integrally injection molded.

A heat insulating material is foamed between the inner case 11 and the outer case 12 to secure insulation of the refrigerator 1.

The refrigerator 1 may include a plurality of storage compartments. The plurality of storage compartments may include the first storage compartment 20 and the second storage compartment 30. The first storage compartment 20 and the second storage compartment 30 may be partitioned by a partition wall 13.

The first storage compartment 20 may be provided at an upper portion of the refrigerator 1, and the second storage compartment 30 may be divided and provided at a lower portion of the refrigerator 1. However, a shape and number of the storage compartments 20 are not limited thereto.

The refrigerator 1 may include a refrigerating compartment and a freezing compartment. For example, the first storage compartment 20 may be provided as the refrigerating compartment, and the second storage compartment 30 may be provided as the freezing compartment. However, positions of the refrigerating compartment and the freezing compartment are not limited thereto.

Referring to FIG. 1, the first storage compartment 20 positioned at the upper portion of the refrigerator 1 may be provided as the refrigerating compartment, and the second storage compartment 30 positioned at the lower portion of the refrigerator 1 may be provided as the freezing compartment. The refrigerating compartment may be kept at approximately 3 degrees Celsius and the freezing compartment may be kept at approximately minus 20 degrees Celsius.

The storage compartment 20 may be opened and closed by a plurality of doors 21, 22, and 31. The first storage compartment 20 may be opened and closed by the first door 21 and the second door 22 rotatably coupled to the main body 10.

The second storage compartment 30 may be opened and closed by the third door 31 slidably coupled to the main body 10. The third door 31 may include a front panel 32 forming a front exterior of the refrigerator 1 and a partition wall 33 extending rearward of the front panel 32. The front panel 32 and the partition wall 33 may form the third storage compartment 20. A handle 34 may be formed at an upper end of the front panel 32 so that a user may grip the handle 34.

However, a shape and operation of the plurality of doors 21, 22, and 31 are not limited thereto, and may be variously provided as long as they may open and close the storage compartment 20.

A plurality of door guards 25 capable of storing objects and the like may be provided on rear surfaces of the first door 21 and the second door 22. The plurality of door guards 25 may be provided to accommodate objects and the like having small volume.

The refrigerator 1 may include a cooling system provided to supply cold air to the storage compartment 20.

The cooling system may include a compressor, a condenser, an expansion valve, an evaporator, and a blowing fan. This cooling system may be disposed, for example, in a machine room provided at a lower rear side of the main body 10.

The refrigerator 1 may include a duct 100 (see FIG. 2) provided to flow cold air generated through the cooling system into the storage compartment 20.

The refrigerator 1 may include a plurality of shelves 40, 41, and 42 disposed inside the first storage compartment 20. The plurality of shelves 40, 41, 42 may be provided and disposed at different heights inside the first storage compartment 20. Details regarding this will be described later.

The refrigerator 1 may include a storage box 24 provided inside the first storage compartment 20. The storage box 24 may be provided in a substantially box shape to make to be drawn out from under the shelf 41. Fresh foods such as vegetables and fruits may be placed inside the storage box 24. The refrigerator 1 may be provided with a cold air control device capable of separately adjusting a degree of cooling of the cold air inside the storage box 24.

Figure 2:
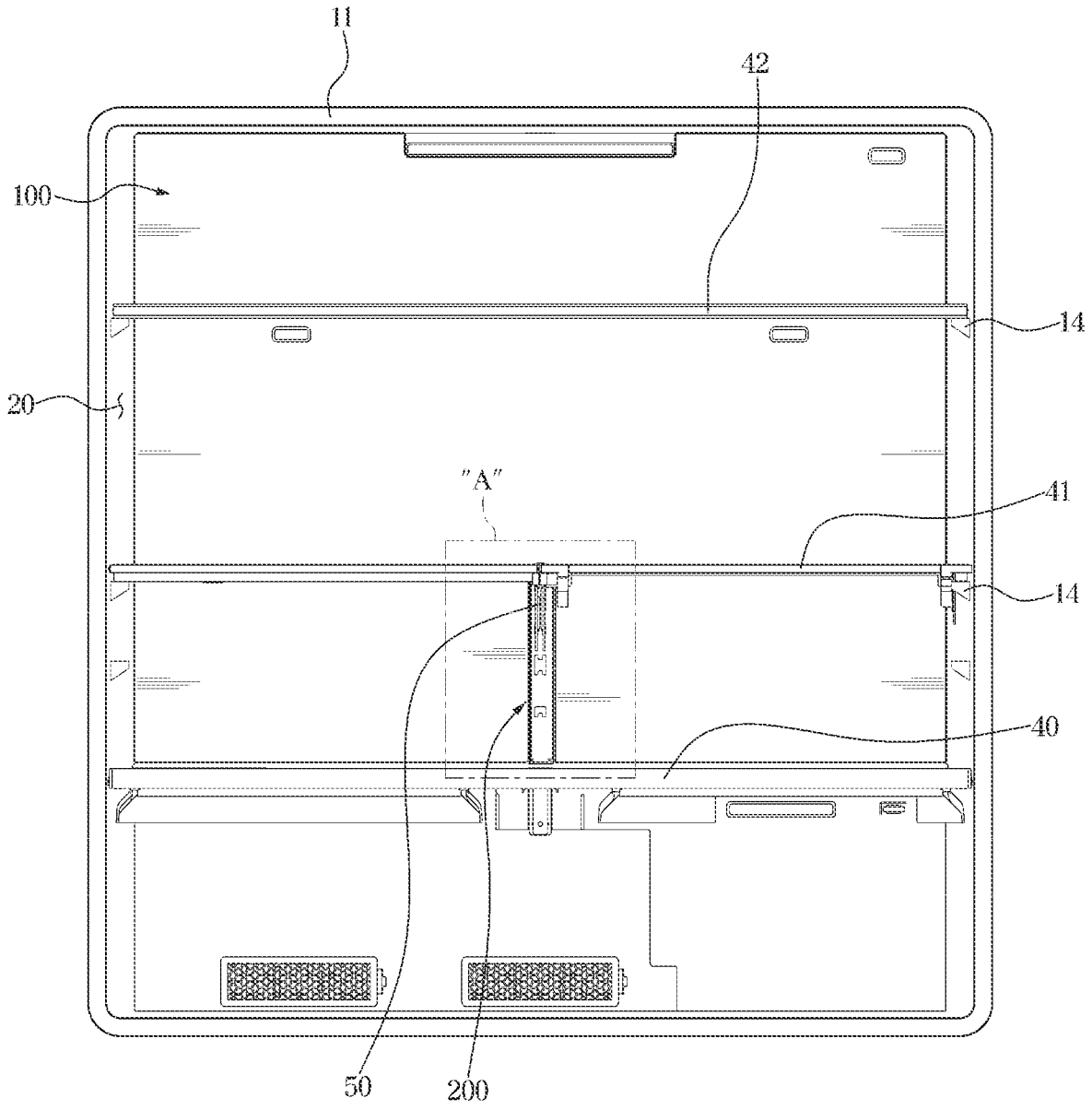
FIG. 2 is a front view illustrating a first storage compartment of the refrigerator from which storage boxes are removed, according to an embodiment.
Figure 3:
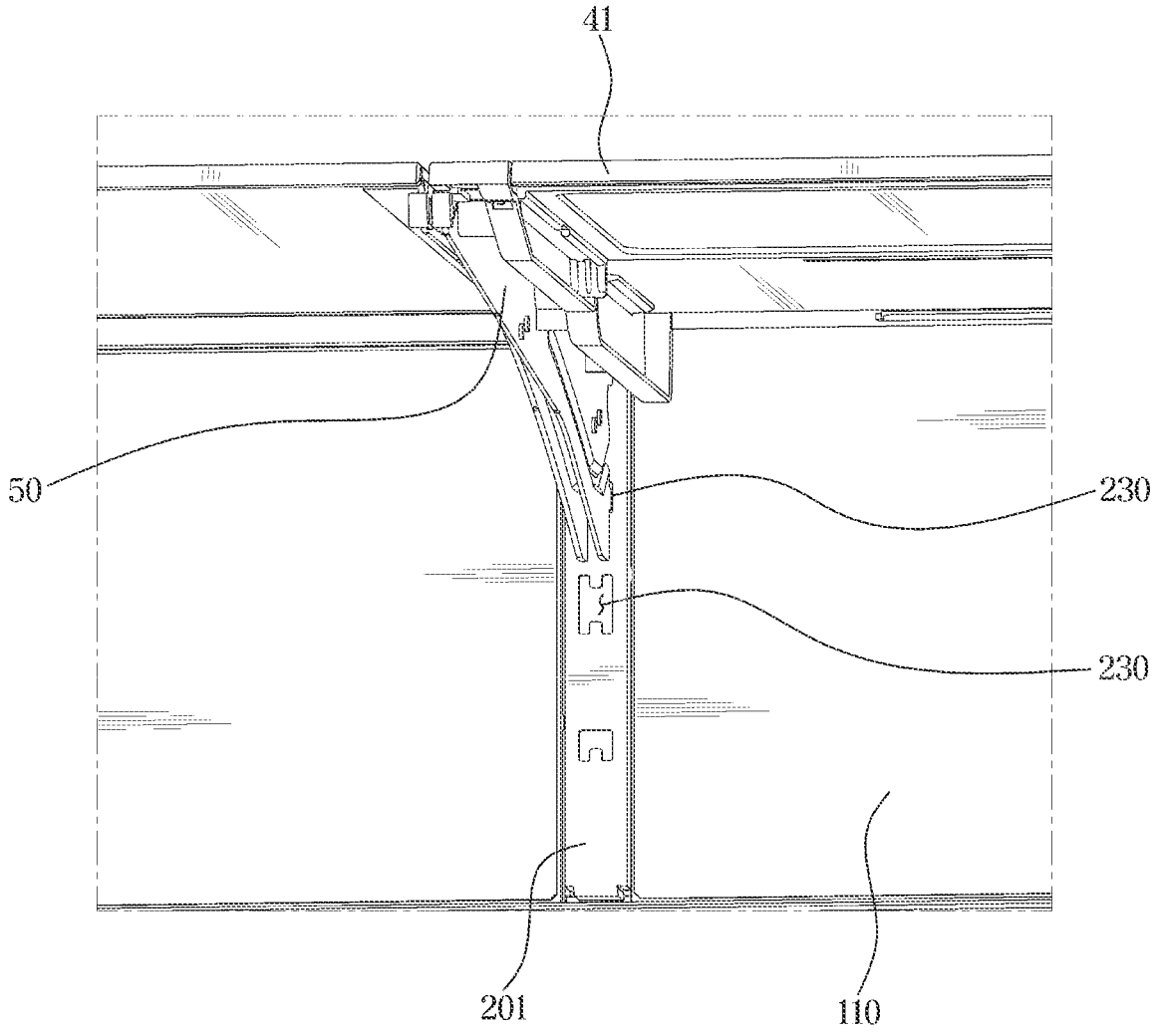
FIG. 3 is an enlarged bottom perspective view of part A in FIG. 2, according to an embodiment.

FIG. 2 is a front view illustrating a first storage compartment of the refrigerator from which storage boxes are removed, according to an embodiment. FIG. 3 is an enlarged bottom perspective view of part A in FIG. 2, according to an embodiment.

Referring to FIGS. 2 and 3, the duct 100 may be mounted on the inner case 11 of the refrigerator 1. The duct 100 may be provided in the first storage compartment 20. Hereinafter, for convenience of description, the first storage compartment 20 will be described as the storage compartment 20.

The duct 100 may be mounted on the inner case 11 to form a flow path for supplying cold air to the storage compartment 20. The duct 100 may be mounted on one surface of the storage compartment 20. In an embodiment, the duct 100 may be coupled to a rear surface of the inner case 11.

Accordingly, when a user opens the first door 21 or the second door 22, the duct 100 may be disposed toward the front of the storage compartment 20 to face the user. In an embodiment, a front cover 110 of the duct 100 may be seen in a field of view of the user by being disposed to be exposed to the storage compartment 20.

The refrigerator 1 may include a plurality of shelves 40, 41, and 42. The plurality of shelves 40, 41, and 42 may be disposed inside the storage compartment 20. The plurality of shelves 40, 41, and 42 may include the first shelf 40, the second shelf 41, and the third shelf 42. The plurality of shelves 40, 41, and 42 may be disposed in front of the duct 100. However, a number of the shelves is not limited thereto.

The refrigerator 1 may include a plurality of beads 14. The beads 14 may be formed to protrude from the inner case 11 toward the storage compartment 20. The shelves 40, 41, and 42 may be seated on upper surfaces of the beads 14 so that positions thereof may be fixed.

The first shelf 40 may be disposed at the lowest height in the storage compartment 20 among the plurality of shelves 40, 41, and 42. The storage box 24 (see FIG. 1) may be slidably coupled below the first shelf 40 to make to be drawn out.

The third shelf 42 may be disposed at the highest height in the storage compartment 20 among the plurality of shelves 40, 41, and 42.

The second shelf 41 may be provided between the first shelf 40 and the third shelf 42. The second shelf 41 may be a height-variable shelf provided to have a variable height.

Also, the second shelf 41 may be provided such that the left and right sides are separated based on the angle 200, which will be described later. Through this, the second shelf 41 may be provided as a half shelf that may be formed such that the left and right sides have different heights. However, a shape of the second shelf 41 is not limited thereto and may be provided as a full shelf integrally formed.

For convenience of description, hereinafter, the second shelf 41, which is a variable-height shelf, will be referred to as a shelf.

The refrigerator 1 may include a support bracket 50. The support bracket 50 may be coupled to the shelf 41 to support a lower portion of the shelf 41. The support bracket 50 may include a plurality of fixing jaws. This is a configuration provided to fix a position of the shelf 41 by being inserted into shelf fixing holes 230 of the angle 200, which will be described later.

The refrigerator 1 may include the angle 200. The angle 200 may include a plurality of the shelf fixing holes 230 into which the fixing jaws of the support bracket 50 coupled to the shelf 41 to support the shelf 41 are inserted. The plurality of shelf fixing holes 230 may be formed on a front surface 201 of the angle 200. The angle 200 may be coupled to the duct 100. Details of the angle 200 will be described later.

Accordingly, the shelf 41 is supported by the support bracket 50, and the fixing jaws of the support bracket 50 are inserted into the shelf fixing holes 230 of the angle 200, so that the position of the shelf 41 may be fixed.

Figure 4:
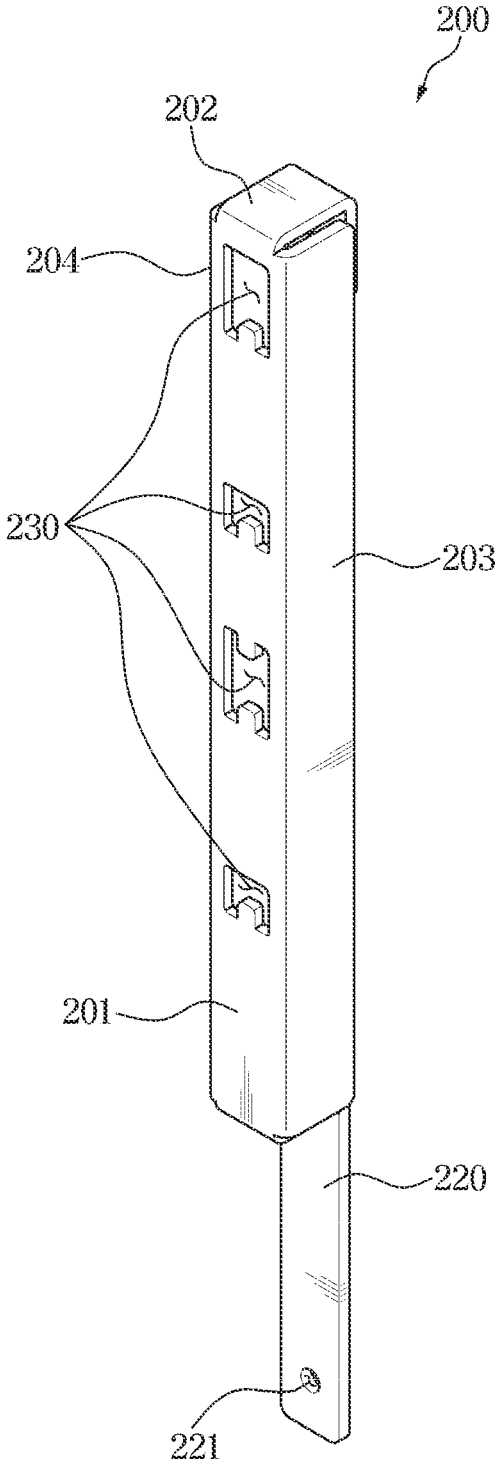
FIG. 4 is a front perspective view of an angle of the refrigerator, according to an embodiment.
Figure 5:
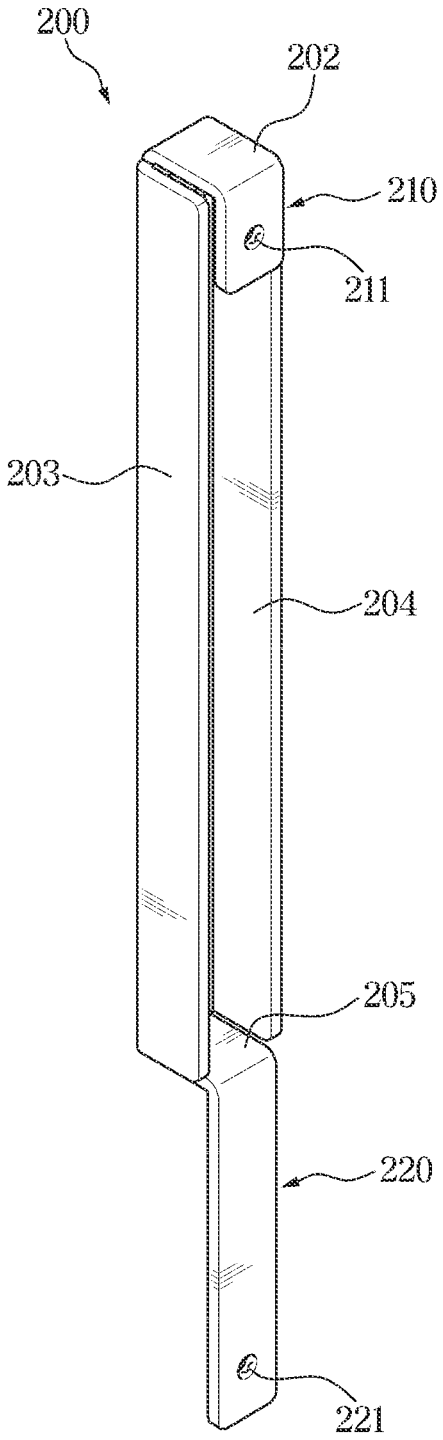
FIG. 5 is a rear perspective view of an angle of the refrigerator, according to an embodiment.

FIG. 4 is a front perspective view of the angle 200 of the refrigerator 1, according to an embodiment. FIG. 5 is a rear perspective view of the angle 200 of the refrigerator 1, according to an embodiment.

Referring to FIGS. 4 and 5, the angle 200 may include the front surface 201, and a plurality of side walls 202, 203, 204, and 205 extending rearward from the front surface 201.

The plurality of side walls 202, 203, 204, and 205 may include the first side wall 202, the second side wall 203, the third side wall 204, and the fourth side wall 205.

The first side wall 202 may form an upper surface of the angle 200. The second side wall 203 and the third side wall 204 may form side surfaces of the angle 200. The fourth sidewall 205 may form a lower surface of the angle 200.

The angle 200 may include the plurality of shelf fixing holes 230. The plurality of shelf fixing holes 230 may be formed on the front surface 201 of the angle 200. The fixing jaws of the support bracket 50 (see FIG. 3) may be inserted into the plurality of shelf fixing holes 230.

The angle 200 may include a bent part 210 formed to be bent inward from one end of the angle 200. Specifically, the bent part 210 may be bent to be provided at the rear with respect to the front surface 201 of the angle 200. In other words, the bent part 210 may be bent from the first sidewall of the angle 200 toward the inside of the angle 200.

Accordingly, the bent part 210 may be provided at the rear with respect to the front surface 201 of the angle 200. A first coupling hole 211 may be formed on the bent part 210. The first coupling hole 211 may be provided for coupling with the duct 100. A separate fastening member may couple the angle 200 and the duct 100 by penetrating the first coupling hole 211 and a second coupling hole 122 of the duct 100, which will be described later. The fastening member may be provided as a member such as a screw. However, a coupling method between the angle 200 and the duct 100 is not limited thereto.

In addition, the bent part 210 may be provided to be in contact with a fixing protrusion 160 of the duct 100, which will be described later. Details regarding this will be described later.

The angle 200 may include a stepped part 220 formed to be bent outward from the other end opposite to one end of the angle 200. The stepped part 220 may be provided to form a step with respect to the front surface 201 of the angle 200. A third coupling hole 221 may be formed on the stepped part 220. The third coupling hole 221 may be provided for coupling with the duct 100. A separate fastening member may couple the angle 200 and the duct 100 by penetrating the third coupling hole 221 and a fourth coupling hole 123 of the duct 100, which will be described later.

Figure 6:
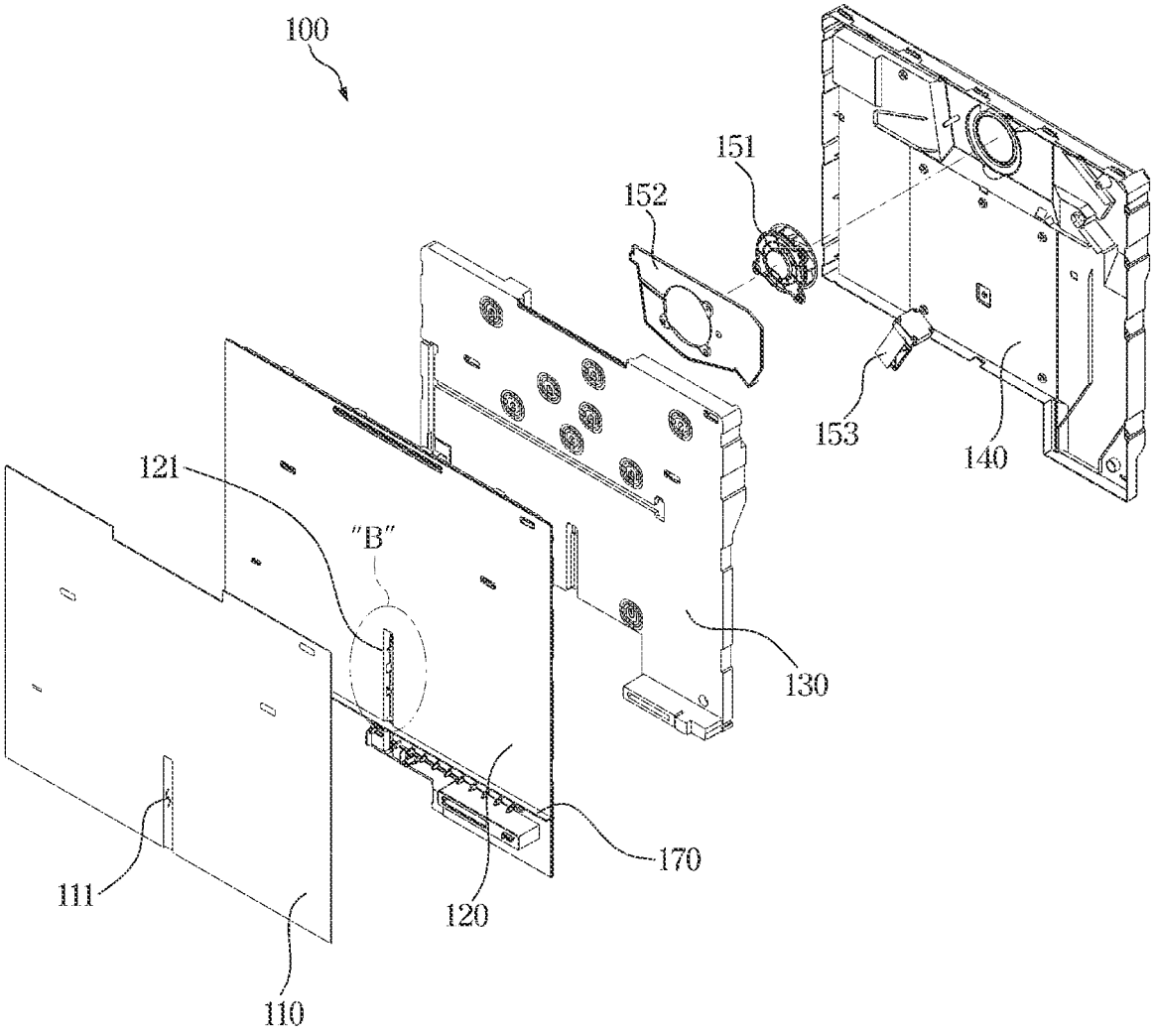
FIG. 6 is an exploded perspective view of a duct of the refrigerator, according to an embodiment.
Figure 7:
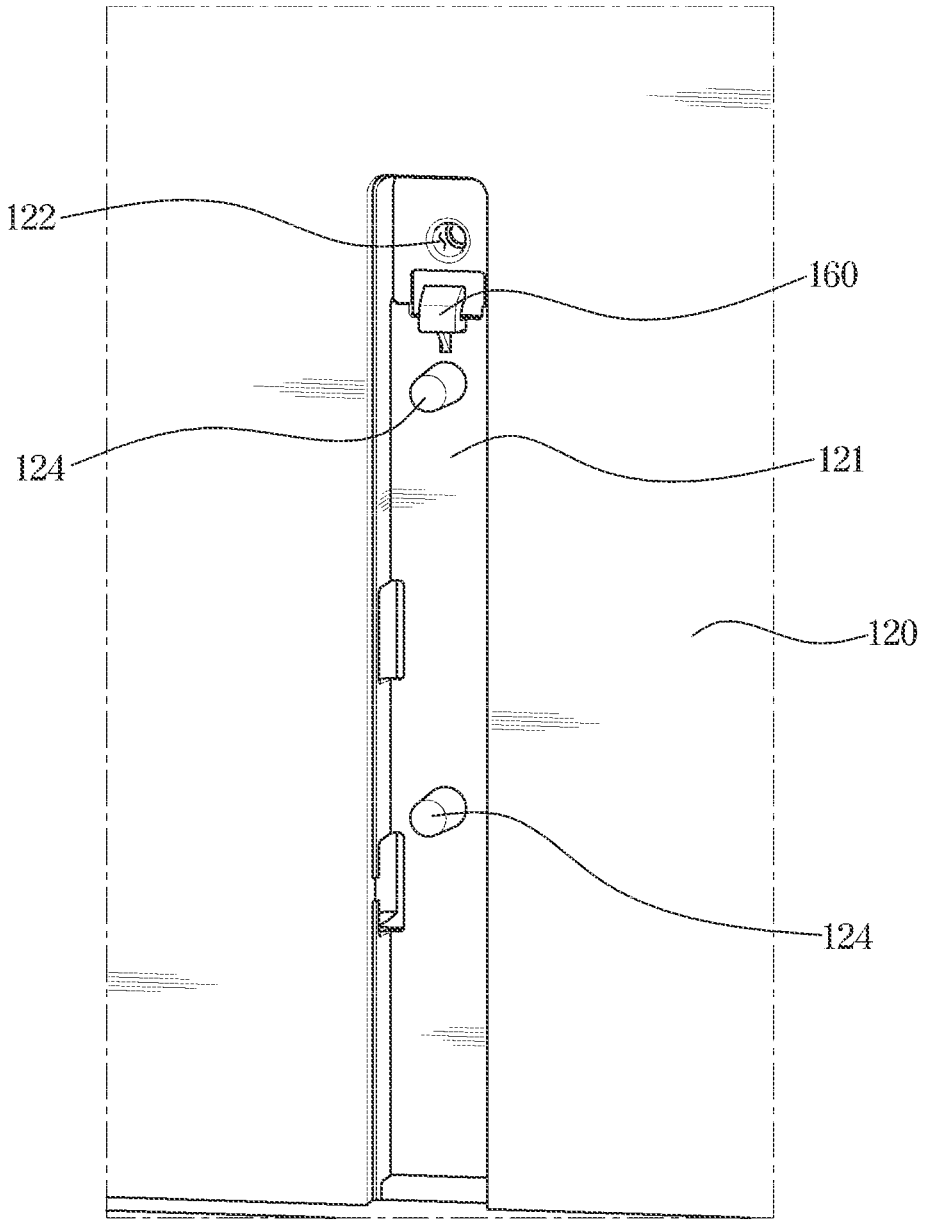
FIG. 7 is an enlarged perspective view of part B in FIG. 6, according to an embodiment.

FIG. 6 is an exploded perspective view of the duct 100 of the refrigerator 1, according to an embodiment. FIG. 7 is an enlarged perspective view of part B in FIG. 6, according to an embodiment.

Referring to FIG. 6, the duct 100 may include the front cover 110 and a support plate 120 supporting the front cover 110.

The front cover 110, which is a component positioned at the most front of the duct 100, may be disposed to be exposed to the storage compartment 20. The front cover 110 may be detachably provided on the support plate 120 to implement various designs inside the refrigerator.

That is, the front cover 110 may form a front exterior of the duct 100 by being exposed to the storage compartment 20.

The support plate 120 may be provided to fix the front cover 110. The support plate 120 may be provided to support the front cover 110 at the rear thereof. A plurality of sensors may be mounted on the support plate 120. The plurality of sensors may be a temperature sensor and a humidity sensor. In addition, a plurality of deodorizers may be attached to the support plate 120 to deodorize the inside of the refrigerator.

Although the support plate 120 and the front cover 110 have been described as being provided separately, the support plate 120 and the front cover 110 may be integrally formed.

The duct 100 may include a heat insulating member 130 mounted at the rear of the support plate 120. The heat insulating member 130 may be provided to block heat exchange between warm air in the refrigerator and cold air generated through the cooling system. The heat insulating member 130 may be made of a material such as urethane foam, but is not limited thereto.

The duct 100 may include a rear plate 140. The rear plate 140 may be coupled with the support plate 120 to form a flow path through which cold air flows.

The duct 100 may include a blowing unit 150. The blowing unit 150 may include a fan 151, an air guide 152, and a damper 153.

The fan 151 may be mounted on the rear plate 140. The fan 151 may be provided to assist a flow of cold air generated by the cooling cycle.

The air guide 152 may be provided to form a circulation flow path through which cold air around the fan 151 smoothly flows. The air guide 152 may also be provided to fix a position of the fan 151. The air guide 152 as described above may be designed such that an appropriate flow pressure is formed around the fan 151. The air guide 152 may be mounted on the rear plate 140 together with the fan 151.

The damper 153 may be mounted on the rear plate 140. The damper 153 may be provided to vary a cross-sectional area inside a flow path through which cold air flows. The damper 153 may be provided to adjust a supply amount of cold air to be supplied to the storage compartment 20 by being controlled depending on a set temperature in the refrigerator.

The support plate 120 may include an angle mounting part 121 formed to be recessed inward from a front surface 201 of the support plate 120 so that the angle 200 is mounted thereon.

The support plate 120 may include a rib 170. The rib 170 may be provided in a horizontal direction with respect to the storage compartment 20. The rib 170 may extend toward the storage compartment 20 from the front surface of the support plate 120. In other words, the rib 170 may extend forward of the support plate 120.

The front cover 110 may include a cutout portion 111 formed by being cut at a position corresponding to the angle mounting part 121.

Referring to FIG. 7, the duct 100 may include the fixing protrusion 160. The fixing protrusion 160 may protrude from the duct 100 toward the storage compartment 20. In an embodiment, the fixing protrusion 160 may be formed on the angle mounting part 121 of the support plate 120.

The support plate 120 may include the second coupling hole 122. The second coupling hole 122 may be provided at a position corresponding to the first coupling hole 211 formed on the bent part 210 of the angle 200 described above. The second coupling hole 122 may be formed on the angle mounting part 121 of the support plate 120.

The support plate 120 may include a reinforcement part 124. The reinforcement part 124 may extend toward the storage compartment 20 from the angle mounting part 121 of the support plate 120. The reinforcement part 124 may be provided to reinforce a strength of the angle 200 by supporting the inside of the front surface 201 of the angle 200 when the angle 200 is mounted on the angle mounting part 121. The reinforcement part 124 may also be provided such that the angle 200 is firmly coupled to the support plate 120.

Figure 8:
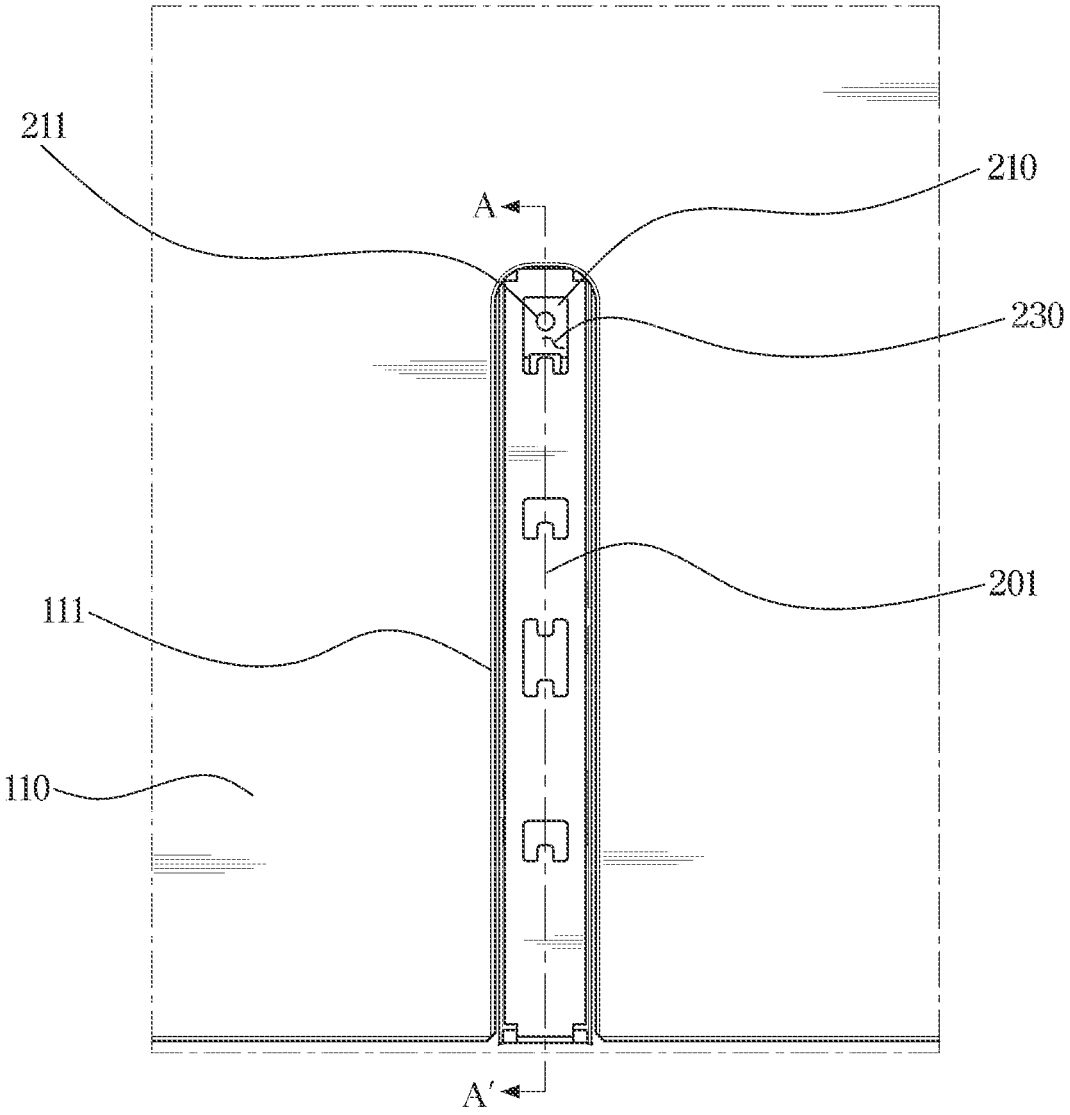
FIG. 8 is a front view illustrating a state in which an angle of the refrigerator is coupled to a duct, according to an embodiment.
Figure 9:
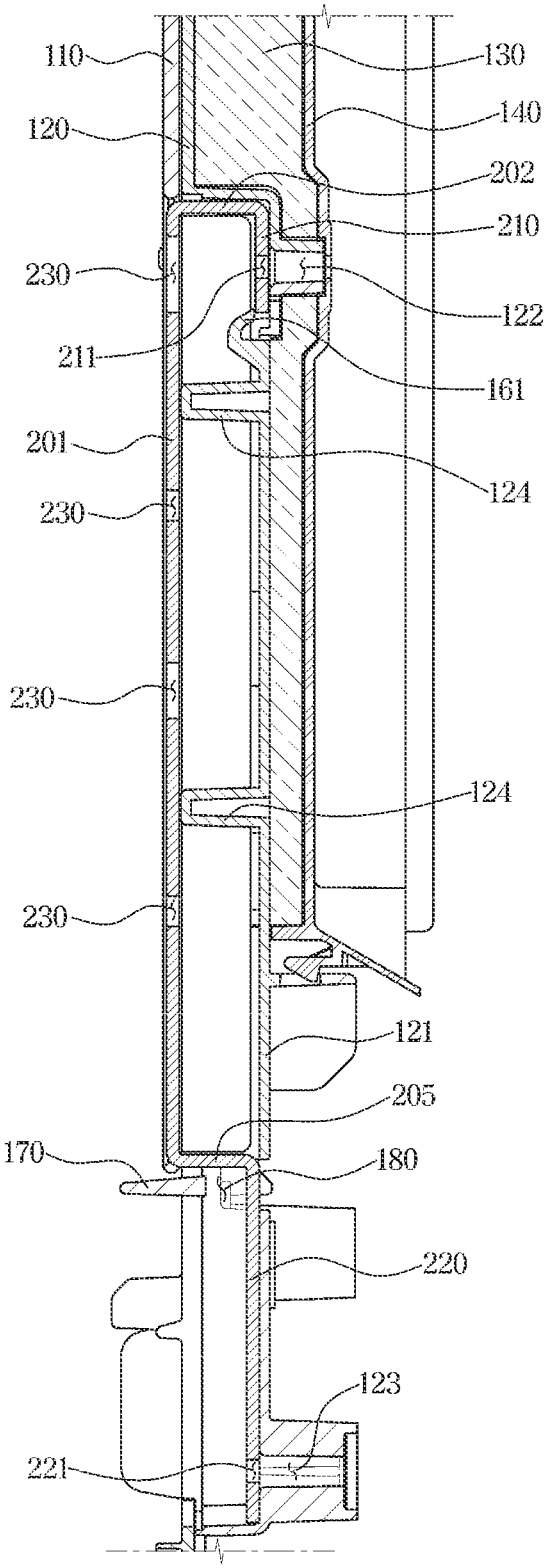
FIG. 9 is a cross-sectional view taken along a line A-A' in FIG. 8, according to an embodiment.

FIG. 8 is a front view illustrating a state in which an angle of the refrigerator is coupled to a duct, according to an embodiment. FIG. 9 is a cross-sectional view taken along a line A-A' in FIG. 8, according to an embodiment.

Referring to FIGS. 8 and 9, the front surface 201 of the angle 200 may be exposed to the storage compartment 20 through the cutout portion 111 of the front cover 110. In addition, as the bent part 210 of the angle 200 is disposed inside the duct 100, the first coupling hole 211 formed in the bent part 210 may not be exposed to the storage compartment 20.

In addition, when the shelf 41 is mounted in the shelf fixing holes 230 of the angle 200, the first coupling hole 211 may not be exposed to the user by being completely covered by the shelf 41.

Hereinafter, a coupling relationship between the angle 200 and the duct 100 will be described.

Referring to FIG. 9, the angle 200 may be coupled to the inside of the duct 100.

The fixing protrusion 160 of the duct 100 may fix the angle 200 by pressing an inner surface of the bent part 210 of the angle 200. In an embodiment, the fixing protrusion 160 may include a hook part 161 provided to press the bent part 210 of the angle 200 toward the inside of the duct 100.

The hook part 161 may be provided in a substantially hook shape to prevent the angle 200 from being separated by pressing the angle 200 backward.

The hook part 161 may be disposed between the front surface 201 of the angle 200 and the bent part 210. The hook part 161 may be provided to come into contact with the bent part 210 so as to temporarily fix a position of the angle 200.

The support plate 120 may include a separation space 180 formed between the rib 170 and the angle mounting part 121. Through the separation space 180, the stepped part 220 of the angle 200 may be accommodated in the separation space 180. In an embodiment, an upper portion of the stepped part 220 may be accommodated in the separation space 180 and a lower portion of the stepped part 220 may be exposed toward the storage compartment 20.

As the rib 170 is provided in front of the stepped part 220, the stepped part 220 of the angle 200 may be prevented from being separated forward from the duct 100.

Therefore, as the fixing protrusion 160 is formed on the support plate 120 to temporarily fix the bent part 210 formed at one end of the angle 200 and the rib 170 is formed on the support plate 120 to prevent the stepped part 220 formed at the other end of the angle 200 from being separated, a structure temporarily fixed between the angle 200 and the duct 100 may be implemented.

In this case, the angle 200 may be temporarily fixed to the duct 100 and delivered prior to a production line for producing a finished product of the refrigerator 1. That is, the position of the angle 200 may be fixed even before the angle 200 is fastened to the duct 100. Thus, the overall productivity of the product may be improved.

The angle 200 may be firmly coupled to the duct 100 by a fastening member.

In an embodiment, as a fastening member is coupled to the first coupling hole 211 of the angle 200 and the second coupling hole 122 of the support plate 120, the bent part 210 of the angle 200 may be coupled to the duct 100. In addition, as a fastening member is coupled to the third coupling hole 221 of the angle 200 and the fourth coupling hole 123 of the support plate 120, the stepped part 220 of the angle 200 may be coupled to the duct 100.

In this case, because the first coupling hole 211 of the bent part 210 is not formed in front of the angle 200 but is formed at the rear of the angle 200, which is an inward direction of the duct 100, the first coupling hole 211 may not be exposed to the user.

In addition, because the third coupling hole 221 of the stepped part 220 is disposed below the first shelf 40 as illustrated in FIG. 2, when the storage box 24 is inserted below the first shelf 40, the third coupling hole 221 is naturally not exposed to the user.

Therefore, in the refrigerator 1, according to an embodiment, because a portion to which the fastening member coupling the angle 200 and the duct 100 is fastened may not be exposed to the user, the aesthetics inside the refrigerator may be improved.

The rib 170 of the support plate 120 may be provided to protrude forward of the front cover 110. When water vapor condensation occurs due to a difference between an internal temperature of the storage compartment 20 and an external temperature, dew or water droplets may be formed on the duct 100. Specifically, dew or water droplets may be formed on the front cover 110.

In this case, the dew is moved downward by gravity, and collected on the upper surface of the rib 170 due to the rib 170 protruding forward of the front cover 110. Through this, water is prevented from being collected on a bottom surface of the storage compartment 20. In addition, the rib 170 prevents moisture from penetrating into food in the storage box 24 so that the freshness of the food may be secured.

Figure 10:
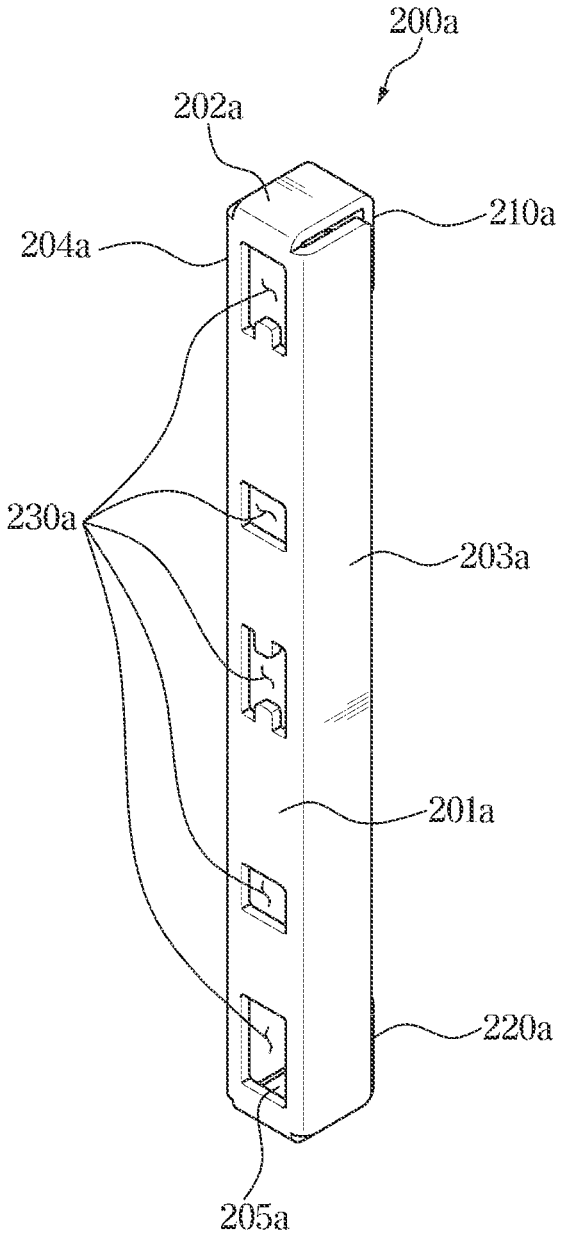
FIG. 10 is a front perspective view of an angle of the refrigerator, according to an embodiment.
Figure 11:
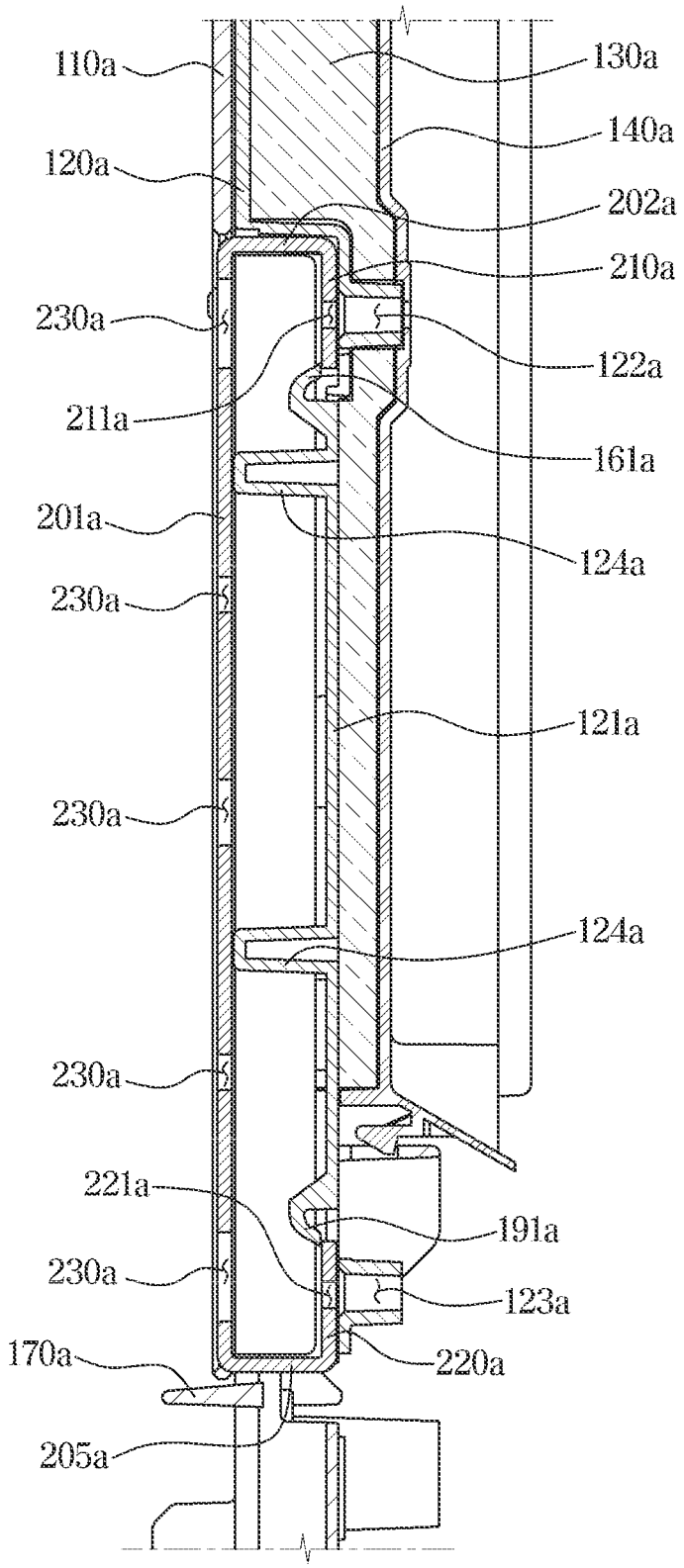
FIG. 11 is a cross-sectional view illustrating a state in which an angle of the refrigerator is coupled to a duct, according to an embodiment.

FIG. 10 is a front perspective view of an angle 200*a* of the refrigerator, according to an embodiment. FIG. 11 is a cross-sectional view illustrating a state in which the angle 200*a* of the refrigerator is coupled to a duct, according to an embodiment.

Hereinafter, contents different from the angle 200 of the refrigerator will be mainly described. Configurations not separately described may be provided to be the same as the configurations of the angle 200 of the refrigerator, and the same reference numerals may be used.

Referring to FIGS. 10 and 11, the angle 200*a* of the refrigerator may include a front surface 201*a*, and a plurality of side walls 202*a*, 203*a*, 204*a*, and 205*a* extending rearward from the front surface 201*a*.

The plurality of side walls 202*a*, 203*a*, 204*a*, and 205*a* may include the first side wall 202*a*, the second side wall 203*a*, the third side wall 204*a*, and the fourth side wall 205*a*.

The first side wall 202*a*may form an upper surface of the angle 200*a*. The second side wall 203*a* and the third side wall 204*a* may form side surfaces of the angle 200*a*. The fourth sidewall 205*a* may form a lower surface of the angle 200*a*.

The angle 200*a* may include a plurality of shelf fixing holes 230*a*. The plurality of shelf fixing holes 230*a* may be formed on the front surface of the angle 200*a*. The fixing jaws of the support bracket (see FIG. 3) may be inserted into the plurality of shelf fixing holes 230*a*.

The angle 200*a* may include a first bent part 210*a* formed to be bent inward from one end of the angle 200*a*. Specifically, the first bent part 210*a* may be bent to be provided at the rear with respect to the front surface of the angle 200*a*. In other words, the first bent part 210*a* may be bent from the first sidewall of the angle 200*a* to the inside of the angle 200*a*.

Accordingly, the first bent part 210*a* may be provided at the rear with respect to the front surface of the angle 200*a*. A first coupling hole 211*a* may be formed on the first bent part 210*a*. The first coupling hole 211*a* may be provided for coupling with the duct 100*a*. A separate fastening member may couple the angle 200*a* and the duct 100*a* by penetrating the first coupling hole 211*a* and a second coupling hole 122*a* of the duct 100*a*. The fastening member may be provided as a member such as a screw. However, a coupling method between the angle 200*a* and the duct 100*a* is not limited thereto.

In addition, the first bent part 210*a* may be provided to be in contact with a first fixing protrusion 160*a* of the duct 100*a*.

The angle 200*a* may include a second bent part 220*a* formed to be bent inward from the other end opposite to one end of the angle 200*a*. The second bent part 220*a* may be bent to be provided at the rear with respect to the front surface of the angle 200*a*. In other words, the second bent part 220*a* may be bent from the fourth side wall 205*a* of the angle 200*a* toward the inside of the angle 200*a*.

Accordingly, the second bent part 220*a* may be provided at the rear with respect to the front surface of the angle 200*a*. A third coupling hole 221*a* may be formed on the second bent part 220*a*. The third coupling hole 221*a* may be provided for coupling with the duct 100*a*. A separate fastening member may couple the angle 200*a* and the duct 100*a* by penetrating the third coupling hole 221*a* and a fourth coupling hole 123*a* of the duct 100*a*.

The first bent part 210*a* and the second bent part 220*a* may be provided symmetrically with respect to the center of the angle 200*a* and may include shapes symmetrical to each other.

Referring to FIG. 11, the duct 100*a* may include a front cover 110*a*, a support plate 120*a*, an insulating member 130*a*, and a rear plate 140*a*. The angle 200*a* may be coupled to the inside of the duct 100*a*.

The first fixing protrusion 160*a* of the duct 100*a* may fix the angle 200*a* by pressing an inner surface of the first bent part 210*a* of the angle 200*a*. In an embodiment, the first fixing protrusion 160*a* may include a first hook part 161*a* provided to press the first bent part 210*a* of the angle 200*a* toward the inside of the duct 100*a*. The first hook part 161*a* may be provided in a substantially hook shape to prevent the angle 200*a* from being separated by pressing the angle 200*a* backward.

The first hook part 161*a* may be disposed between the front surface 201*a* of the angle 200*a* and the first bent part 210*a*. The first hook part 161*a* may be provided to come into contact with the first bent part 210*a* so as to temporarily fix a position of the angle 200*a*.

The duct 100*a* may include a second fixing protrusion 190*a*. The second fixing protrusion 190*a* may protrude from the duct 100*a* toward the storage compartment 20 to press an inner surface of the second bent part 220*a*. The second fixing protrusion 190*a* may include a second hook part 191*a* provided to press the second bent part 220*a* of the angle 200*a* toward the inside of the duct 100*a*. The second hook part 191*a* may be provided in a substantially hook shape to prevent the angle 200*a* from being separated by pressing the angle 200*a* backward.

The second hook part 191*a* may be provided in a shape symmetrical with respect to the centers of the first hook part 161*a* and the angle 200*a*.

The support plate 120*a* of the duct 100*a* may include an angle mounting part 121*a* formed to be recessed inward so that the angle 200*a* is mounted thereon. The first fixing protrusion 160*a* may be formed to protrude forward from the angle mounting part 121*a*.

The support plate 120*a* may include a reinforcement part 124*a*. The reinforcement part 124*a* may extend toward the storage compartment 20 from the angle mounting part 121*a* of the support plate 120*a*. The reinforcement part 124*a* may be provided to reinforce a strength of the angle 200*a* by supporting the inside of the front surface of the angle 200*a* when the angle 200*a* is mounted on the angle mounting part 121*a*. The reinforcement part 124*a* may also be provided such that the angle 200*a* is firmly coupled to the support plate 120*a*.

Unlike the duct 100, a rib 170*a* formed on the duct 100*a* does not prevent the angle 200*a* from being separated because a stepped part is not formed on the angle 200*a*. However, the rib 170*a* protrudes forward of the front cover 110*a* to prevent dew forming on the front cover 110*a* from being collected at a lower portion of the storage compartment. In addition, the function of ensuring the freshness of food by preventing moisture from penetrating into the storage box may be performed in the same way.

In an embodiment, a plurality of the fixing protrusions 160*a* and 220*a* may be formed so that the angle 200*a* may be more firmly fixed to the duct 100*a*.

Figure 12:
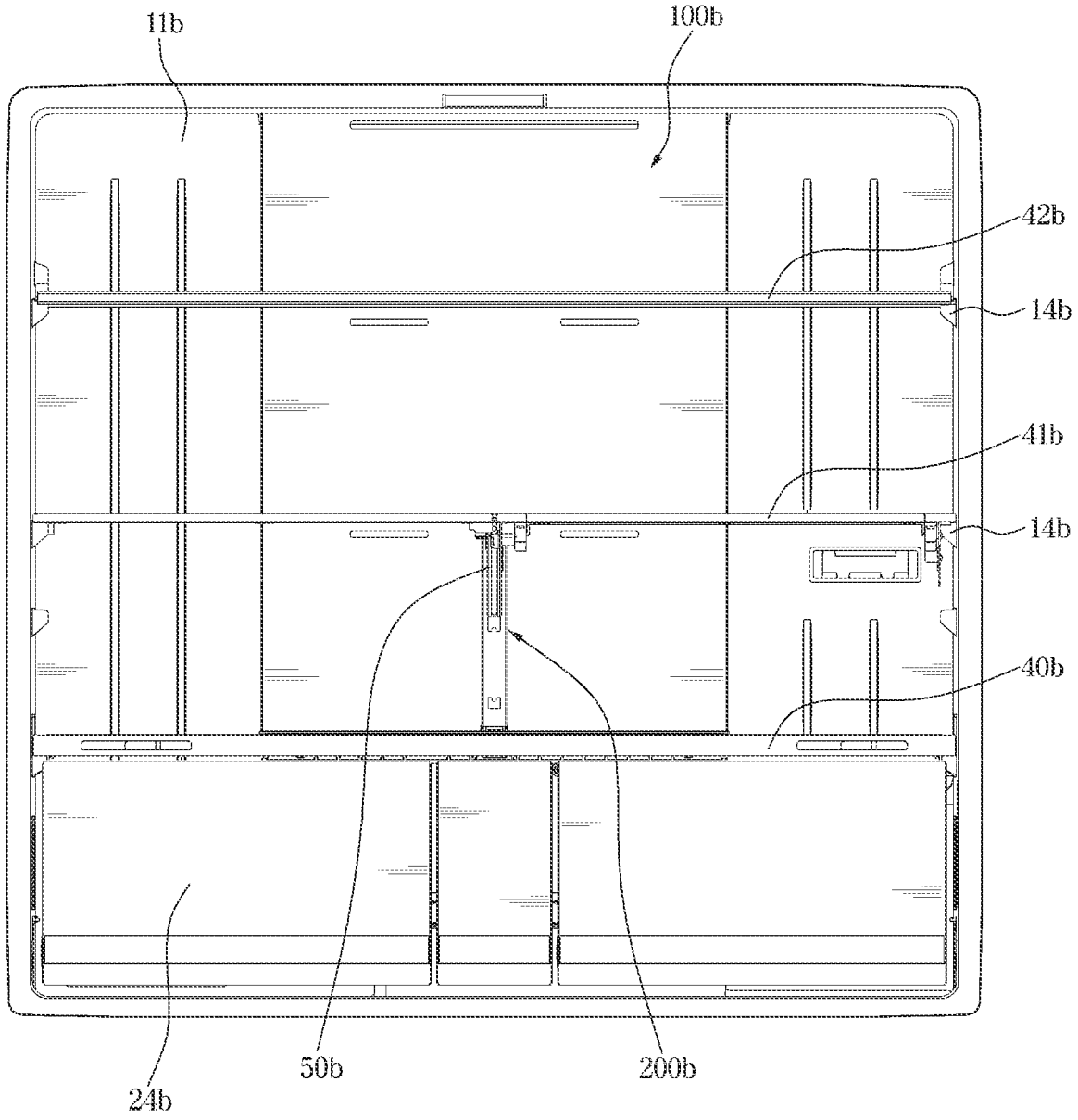
FIG. 12 is a front view illustrating a first storage compartment of the refrigerator, according to an embodiment.

FIG. 12 is a front view illustrating the first storage compartment 20 of the refrigerator, according to an embodiment.

Referring to FIG. 12, a shape of a duct 100*b* may be provided differently.

Specifically, the duct 100*b* may be provided to cover only a central portion of a rear surface of an inner case 11*b*. In addition, a surface of the duct 100*b* may be provided in a flat type or convex type.

The duct 100*b* may be mounted on the inner case 11*b*. The duct 100*b* may be provided in the first storage compartment 20.

The duct 100*b* may be mounted on the inner case 11*b* to form a flow path for supplying cold air to the storage compartment. The duct 100*b* may be mounted on one surface of the storage compartment. In an embodiment, the duct 100*b* may be coupled to a rear surface of the inner case 11*b*. The duct 100*b* may be provided to cover the central portion of the rear surface of the inner case 11*b*.

Accordingly, when the user opens the first door 21 or the second door 22, the duct 100*b* may be disposed toward the front of the first storage compartment 20 to face the user. In an embodiment, a front cover of the duct 100*b* may be seen in a field of view of the user by being disposed to be exposed to the first storage compartment.

The refrigerator may include a plurality of shelves 40*b*, 41*b*, and 42*b*. The plurality of shelves 40*b*, 41*b*, and 42*b* may be disposed inside the first storage compartment 20. The plurality of shelves 40*b*, 41*b*, and 42*b* may include the first shelf 40*b*, the second shelf 41*b*, and the third shelf 42*b*. The plurality of shelves 40*b*, 41*b*, and 42*b* may be disposed in front of the duct 100*b*. However, a number of the shelves is not limited thereto.

The refrigerator may include a plurality of beads 14*b*. The beads 14*b* may be formed to protrude from the inner case 11*b* toward the first storage compartment 20. The shelves may be seated on upper surfaces of the beads 14*b* so that positions thereof may be fixed.

The first shelf 40*b* may be a shelf disposed at the lowest height in the first storage compartment 20 among the plurality of shelves 40*b*, 41*b*, and 42*b*. A storage box 24*b* may be slidably coupled below the first shelf 40*b* to make to be drawn out.

The third shelf 42*b* may be a shelf disposed at the highest height in the first storage compartment 20 among the plurality of shelves 40*b*, 41*b*, and 42*b*.

The second shelf 41*b* may be a shelf provided between the first shelf 40*b* and the third shelf 42*b*. The second shelf 41*b* may be a height-variable shelf provided to have a variable height.

Also, the second shelf 41*b* may be provided such that the left and right sides are separated based on the angle 200*b*. Through this, the second shelf 41*b* may be provided as a half shelf that may be formed such that the left and right sides have different heights. However, a shape of the second shelf is not limited thereto and may be provided as a full shelf integrally formed.

For convenience of description, hereinafter, the second shelf 41*b*, which is a variable-height shelf, will be referred to as a shelf.

The refrigerator may include a support bracket 50*b*. The support bracket 50*b* may be coupled to the shelf to support a lower portion of the shelf. The support bracket 50*b* may include a plurality of fixing jaws. This is a configuration provided to fix the position of the shelf by being inserted into shelf fixing holes of the angle 200*b*.

The refrigerator may include the angle 200*b*. The angle 200*b* may be provided such that the fixing jaws of the support bracket 50*b* are inserted therein to fix the positions of the support bracket 50*b* and the shelf.

The embodiments of the present disclosure have been shown and described above with reference to the accompanying drawings. The embodiments disclosed in the specification and drawings are only intended to provide specific examples for easily describing the technical content of the disclosure and for assisting understanding of the disclosure, and are not intended to limit the scope of the disclosure. It will be understood by those of ordinary skill in the art that the present disclosure may be easily modified into other detailed forms without changing the technical principle or essential features of the present disclosure, and without departing from the gist of the disclosure as claimed by the appended claims and their equivalents. Therefore, it should be interpreted that the scope of the disclosure includes all changes or modifications derived based on the technical idea of the disclosure in addition to the embodiments disclosed herein.

What is claimed is:

1. A refrigerator comprising:

a storage compartment;

a shelf disposed inside the storage compartment;

an angle disposed to fix a position of the shelf, the angle comprising a bent part formed to be bent inward from one end of the angle; and a duct mounted on one surface of the storage compartment and to which the angle is coupled, the duct comprising a fixing protrusion disposed to protrude from the duct toward the storage compartment to fix the angle by pressing an inner surface of the bent part, the fixing protrusion being an integral part of the duct, wherein the bent part comprises a coupling hole configured to couple with the duct, and is disposed at a rear of the angle with respect to a front surface of the angle exposed to the storage compartment and above the inner surface pressed by the fixing protrusion in a vertical direction.

2. The refrigerator of claim 1, wherein the fixing protrusion comprises a hook part disposed to press the inner surface of the bent part toward the inside of the duct.

3. The refrigerator of claim 2, wherein the hook part is disposed to come into contact with the bent part between the front surface of the angle and the bent part.

4. The refrigerator of claim 1, wherein the angle comprises a plurality of shelf fixing holes formed on a front surface of the angle.

5. The refrigerator of claim 1, wherein the duct further comprises:

a front cover disposed to form a front exterior of the duct by being exposed to the storage compartment; and a support plate disposed to fix the front cover at a rear of the front cover and accommodate the angle.

6. The refrigerator of claim 5, wherein the support plate comprises an angle mounting part formed to be recessed inward from a front surface of the support plate so that the angle is mounted thereon.

7. The refrigerator of claim 6, wherein the fixing protrusion is formed on the angle mounting part.

8. The refrigerator of claim 6, wherein the front cover comprises a cutout portion formed by being cut at a position corresponding to the angle mounting part, and a front surface of the angle is exposed to the storage compartment through the cutout portion.

9. The refrigerator of claim 6, wherein the support plate further comprises a rib disposed to extend in a horizontal direction from the front surface of the support plate toward the storage compartment, and disposed to protrude forward of the front cover.

10. The refrigerator of claim 9, wherein the angle further comprises a stepped part disposed to be stepped with the front surface of the angle by being bent outward from the other end of the angle.

11. The refrigerator of claim 10, wherein the support plate further comprises a separation space formed between the rib and the angle mounting part, and disposed to accommodate the stepped part.

12. The refrigerator of claim 1, wherein the coupling hole is a first coupling hole, and a support plate comprises a second coupling hole disposed at a position corresponding to the first coupling hole.

13. The refrigerator of claim 1, wherein the bent part is a first bent part, and the fixing protrusion is a first fixing protrusion, and the refrigerator further comprises a second bent part formed to be bent inward from the other end of the angle, and a second fixing protrusion disposed to protrude from the duct toward the storage compartment to press an inner surface of the second bent part.

14. The refrigerator of claim 13, wherein the first bent part and the second bent part are disposed symmetrically with respect to a center of the angle.

15. The refrigerator of claim 1, wherein the bent part is formed from a top end of the angle, and is bent in a direction toward a bottom end of the angle.

16. The refrigerator of claim 1, wherein the coupling hole is disposed at the rear of the angle such that the coupling hole is spaced apart from the front surface of the angle in a direction away from the storage compartment.

17. The refrigerator of claim 10, wherein the rib is disposed to prevent the stepped part being separated from the duct.

* * * * *